US007097606B2

(12) United States Patent
Calugi

(10) Patent No.: US 7,097,606 B2
(45) Date of Patent: Aug. 29, 2006

(54) DEVICE FOR COVERING PACKAGING BOXES

(75) Inventor: Candido Calugi, Fucecchio (IT)

(73) Assignee: Emmeci S.R.L., Cerreto Guidi (IT)

( * ) Notice: Subject to any disclaimer, the term of this patent is extended or adjusted under 35 U.S.C. 154(b) by 47 days.

(21) Appl. No.: 10/960,509

(22) Filed: Oct. 8, 2004

(65) Prior Publication Data

US 2005/0081489 A1 Apr. 21, 2005

(30) Foreign Application Priority Data

Oct. 16, 2003 (IT) ..... BO2003A0606

(51) Int. Cl.
*B31B 1/48* (2006.01)

(52) U.S. Cl. ..... 493/80; 493/68; 493/70; 493/98; 493/100

(58) Field of Classification Search ..... 493/68, 493/70, 79, 80, 98, 100, 111, 128, 162, 183; 53/209, 203, 375.2, 375.7, 376.8, 377.6
See application file for complete search history.

(56) References Cited

U.S. PATENT DOCUMENTS

| | | | | |
|---|---|---|---|---|
| 1,402,259 | A * | 1/1922 | Smith | 493/68 |
| 1,693,136 | A * | 11/1928 | Carle | 493/76 |
| 1,895,090 | A * | 1/1933 | Stokes | 229/122.24 |
| 2,769,588 | A * | 11/1956 | Beck | 229/116.5 |
| 4,194,441 | A * | 3/1980 | Williams et al. | 493/168 |
| 4,280,810 | A * | 7/1981 | Struble | 493/356 |
| 5,044,547 | A * | 9/1991 | Hartman | 229/175 |
| 5,632,713 | A * | 5/1997 | Canning et al. | 493/162 |
| 6,588,175 | B1 * | 7/2003 | Gaudenzi | 53/378.3 |

* cited by examiner

*Primary Examiner*—Hemant M. Desai
(74) *Attorney, Agent, or Firm*—Nath & Associates PLLC; Jerald L. Meyer; Stanley N. Protigal

(57) ABSTRACT

A device for applying a sheet of covering material (4, 40) to boxes (1) having at least one wall (2, 200) with an outside surface (5, 50), an inside surface (6, 60) and a free edge (3, 30) intermediate between the surfaces (5, 6; 50, 60) comprises one or more elements (10, 100) for folding a flap (7, 70) of the sheet (4) around the intermediate edge (3, 30) so that the flap (7, 70) is made to cover the edge (3, 30) and then applying the flap (7, 70) to the inside surface (6, 60) of the wall (2, 200).

14 Claims, 4 Drawing Sheets

DEVICE FOR COVERING PACKAGING BOXES

BACKGROUND OF THE INVENTION

The present invention addresses the packaging box manufacturing industry and, in particular, relates to a device for covering formed boxes, for example, boxes made from carton blanks, with a sheet of paper.

More specifically, the invention can be used especially (but not exclusively) to cover packaging boxes with parts that are difficult to access such as, for example, the inside edges of parts with complex shapes that have to be covered.

Typical boxes of this kind are folding boxes, consisting of two halves hinged along the long edges of a spine in such a way that they can be placed over each other (usually, one half fits neatly into the other) to form a box for containing products of various kinds.

As is known, these types of boxes are widely used to contain items of value sold to the public, such as perfumes, jewelry, or even CDs and DVDs.

Boxes of this kind have in fact become very popular with the public not only because they are practical but also because they are very attractive, ideal for presenting items of value.

For this reason, the quality and finish of the box covering is very important, in both structural and esthetic terms, for the box to be fully appreciated by the public.

The folding box coverings, however, present numerous difficulties on account of their relatively complex geometry and because the sheet of covering material must reach even the parts of the box that are most difficult to access.

Even greater difficulties are encountered in automatic systems when it is desired to maintain a high level of productivity during the entire process of covering the formed box so as to avoid reducing the efficiency of the production process.

At present, machines are known which cover formed boxes by applying sheets of paper to them by gluing.

In these machines, the box is first positioned precisely over the glued covering sheet, thus covering the bottom of the box.

Next, to cover the outside surfaces of the sidewalls, there are provided transversely mobile elements that move the covering sheet into contact with the corresponding outside surfaces of the walls. The edges of the covering sheet are allowed to extend upwardly past the upper edges of the walls and are later folded downwardly against the inside walls in such a way as to also cover the upper edges of the walls.

The edges of the covering material are folded by further folding elements or blades that move along the upper edges so as to glue the covering material to the box and fold its upper edges towards the inside of the box.

At this point, to complete the covering of the side walls, the free edges of the covering material are pushed against the inside surfaces of the walls by a pad or template pushed downwards vertically so that it comes into contact with the inside surfaces of the box walls.

This solution is usually effective and satisfactory when the boxes to be covered are of the "plain" type, that is to say, with a base and four walls joined to each other at the sides, without free intermediate edges to be covered which are difficult to access.

In the latter case, prior art machines do not solve the problem of covering the free intermediate edges (in this case the vertical edges but not necessarily so) in order to improve the technical and esthetic characteristics of the finished product.

Up to now, the free edges were left uncovered or, when a more elegant package was required, the covering was completed by hand, thus slowing down production and increasing costs.

Another limitation of prior art machines is the use of a mobile pad or template to cover the box edges. The template must be inserted into the box at right angles to the edges to be covered in a direction parallel to the walls of the box and in such a way that it is in contact with the inside surfaces of the box walls.

Consequently, in order to prevent the pad from interfering with the box edges and damaging the box, it must be positioned extremely accurately relative to the box, an operation that may slow down the production process.

For these reasons, a strong need is currently felt for a device and method for covering packaging boxes in full while providing high product quality in very quick time.

SUMMARY OF THE INVENTION

The present invention has for an aim to overcome the above mentioned drawbacks through a box covering device capable of fully covering boxes of any shape, especially boxes with complex shapes.

In accordance with the invention, this aim is achieved by a box covering device and machine as defined in the main appended claims.

The secondary claims describe further advantageous aspects of the device.

The advantages achieved by the invention lie essentially in the fact that all the edges of the box are fully covered in very quick time without adversely affecting the efficiency of the production cycle as a whole.

Further, the device according to the invention is easy to install, even on existing machines, is extremely reliable and has a low production cost.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Below is a description of a device for covering boxes of the type illustrated in FIG. 1.

It will be understood, however, that this shall not restrict the scope of the invention and that the device can be used with boxes of any type where one or more wall edges have to be covered.

Figure 1:
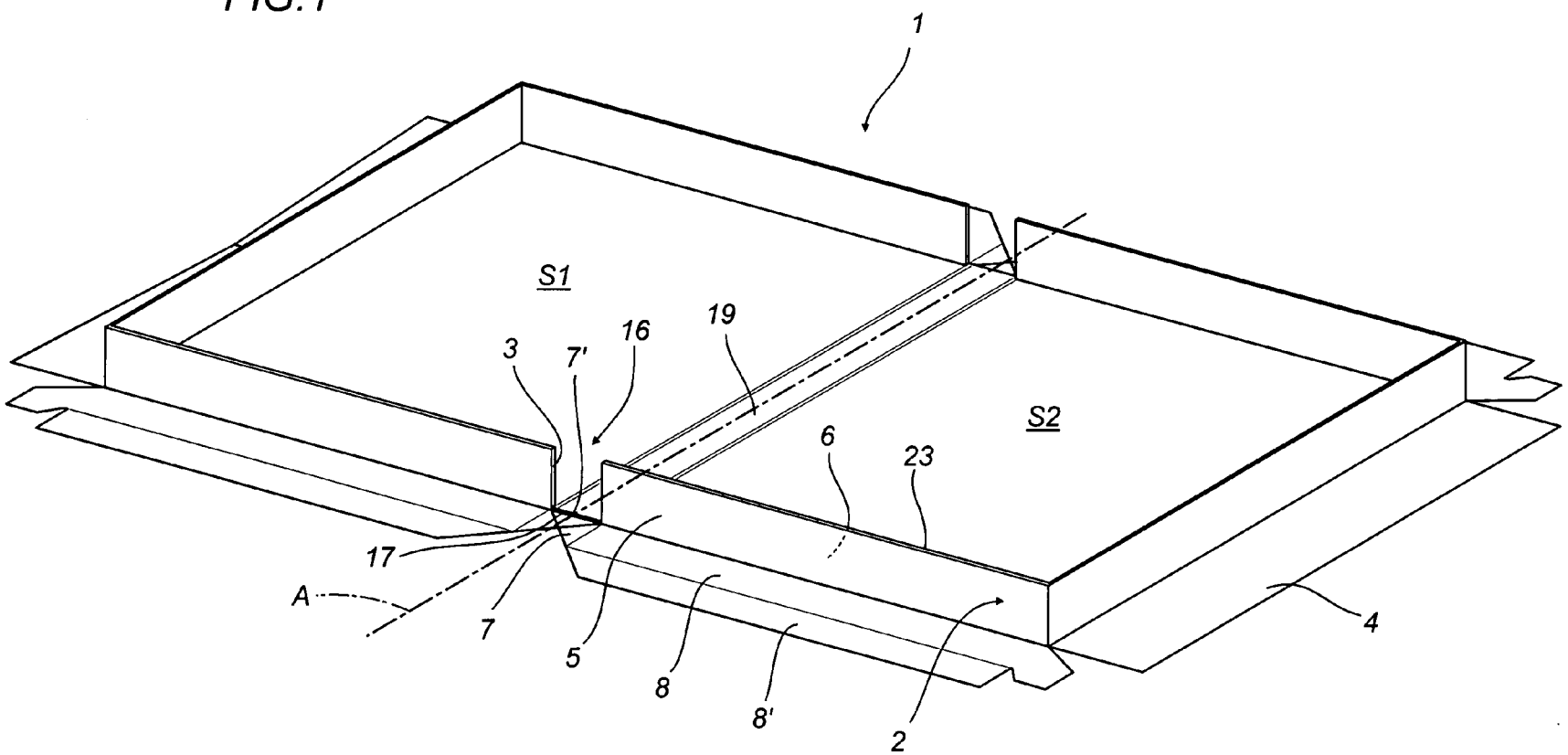
FIG. 1 illustrates a folding box placed over a suitable covering sheet.

With reference to FIG. 1, a box 1 consists of two halves S2, S1 joined at a central spine 19, the half S2 being slightly larger than the half S1 so that the latter fits into the former when the box is closed.

As shown in FIG. 1, in this type of box, the spine 19 and the walls 2 of the box define a recess 16 delimited, at the bottom, by the free edge 17 of the spine and, at the sides, by the edges 3 of the walls 2.

The box is laid over a glued sheet of covering paper 4 consisting of a central portion which is designed to cover the outside of the base of the box 1 and from which there extend peripheral flaps designed to cover the walls 2 and the free edges of the boxes.

Looking in more detail, the sheet of covering paper 4 comprises the following covering flaps:

flaps 8 for covering the outside surfaces of the sidewalls 2 of the box;

flaps 8' contiguous with the flaps 8 and extending upwardly from the walls 2 to cover the upper edges 23 and the inside surfaces 6 of the box sidewalls 2;

flaps 7 laterally contiguous with the flaps 8 and extending towards the line A through the centre of the box 1 and designed to cover the free edges 3 of the walls 2 of the respective halves S1 and S2 making up the box 1;

a central flap 7' for covering the lower free edge 17 of the spine 19.

Figure 2:
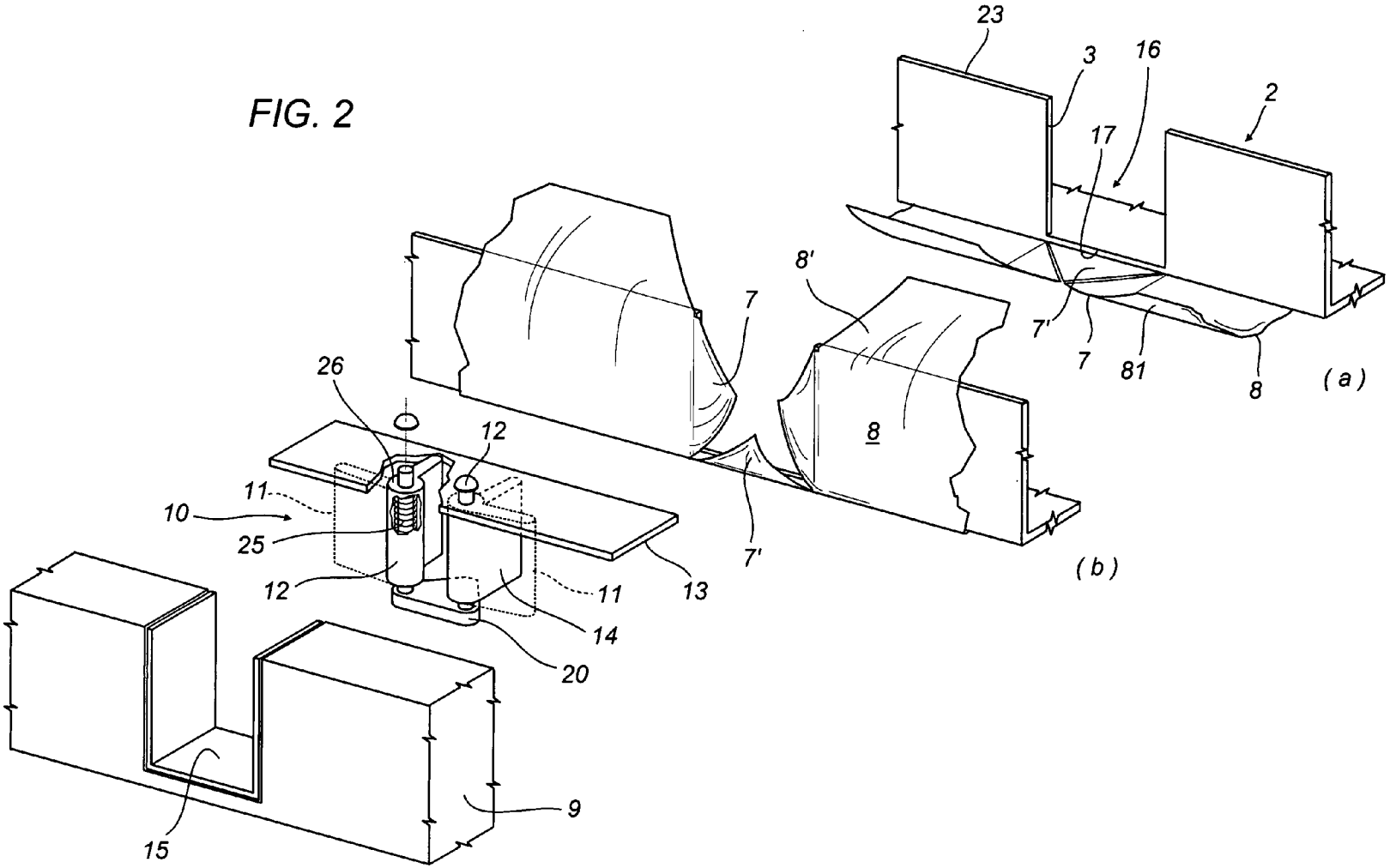
FIG. 2 is a perspective view of the device according to the invention together with a box like the one shown in FIG. 1.
Figure 3:
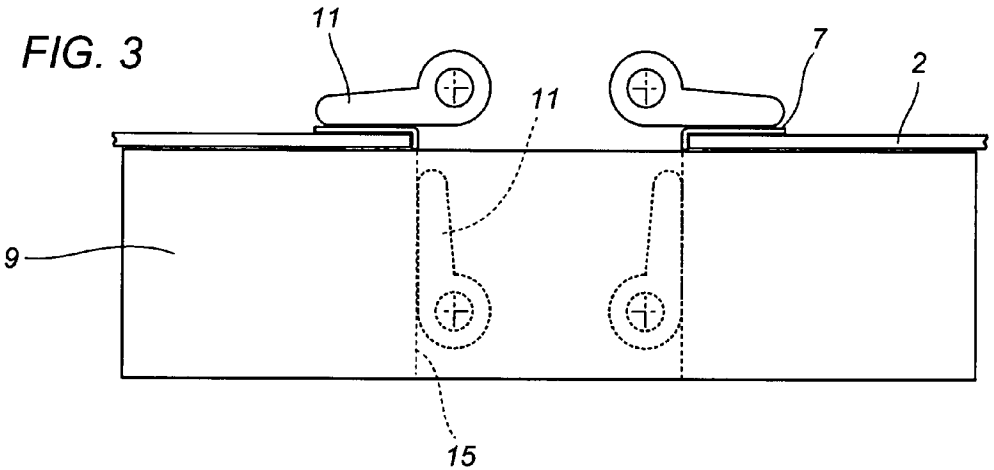
FIG. 3 is a schematic top view of a detail of the device of FIG. 2 in two different working configurations.

FIGS. 2 and 3 illustrate a device according to the invention positioned relative to a box 1.

In FIG. 2(*a*) the box is shown with the base glued to the central portion of a glued covering sheet 4, and the lateral flaps 7, 7', 8, 8' of the sheet 4 slightly raised with respect to the base of the box, ready to cover the walls 2 and the free edges 3, 17, 23.

The device according to the invention comprises:

a compression element or block 9, parallel with the walls 2 and mobile at right angles to them so as to apply the covering flaps 8 to the outside surfaces 5 of the walls 2. The block 9 stably houses a rectangular open top bushing 15 which, during operation, is aligned with the recess 16 of the box 1. In another embodiment, the function of the bushing 15 may be fulfilled directly by the body of the block 9;

a blade 13 that slides over the block 9, parallel with and mobile at right angles to the walls 2, and positioned just above the walls 2 so as to apply the covering to the upper edge 23 of the walls themselves. The movement of the blade 13 relative to the block 9 may be controlled by suitable guides (not illustrated);

a folding element 10 comprising a pair of wings 11, which move as one with the blade 13, each rotating on a return spring 25 wound around pins 12 fixed to the bottom of the blade 13 at the sidewalls of the bushing 15.

Each wing 11 extends preferably for the full depth of the bushing 15 and presents a circular portion 26 crossed by the pin 12 and a straight section 14 that runs along the respective sidewall of the bushing 15.

Protruding frontally from the bottom of the pins 12, there is a plate 20 designed to fold the flap 7' of the covering sheet 4 to cover the edge 17 of the spine 19.

Preferably, the wings 11 and the bushing 15 are made from materials with a low coefficient of reciprocal friction so as to facilitate relative movement between them: for example, steel for the wings and aluminium bronze for the bushing.

During use, the device according to the invention is positioned in such a way as to align the bushing 15 with the recess 16 and, more specifically, in such a way that the wings 11, the blade 13 and the protruding plate 20 are aligned with the edges 3, 23 and 17 of the box 1 designed to be covered, respectively, by the flaps 7, 8' and 7' of the covering sheet 4.

Initially, as illustrated by the dashed line in FIGS. 2 and 3, the wings 11 are retracted in a closed position inside the bushing 15 and the blade 13 is positioned on the block 9, just above and clear of the walls 2.

In order to cover the box, the block 9 moves forward together with the blade 13 until it comes into contact with the walls 2, thus applying the covering flap 8 to the walls 2 (this flap, as mentioned above, being partly raised with respect to the base). For convenience, FIG. 2(*b*) shows the box 1 with the flaps 8 already applied to the outside surfaces of the walls but with the block 9 away from them.

As the block 9 approaches the walls 2, the bottom protruding plate 20 comes into contact with the flap 7' and pushes the latter into the box in such a way as to cover the edge 17 of the spine 19.

The block 9 stops against the sides of the box while the blade 13 continues moving relative to the block 9, thus folding the covering portion 8' of the sheet 4 over the upper edge 23 of the walls 2.

At the same time, the wings 11 slide out of the bushing 15 in the vicinity of the recess 16 in such a way as to fold first the covering flaps 7 over the edges 3 and then spring open to the position illustrated by the continuous line in FIG. 3, so as to press the flaps 7 against the inside surface 6 of the walls 2.

Once the edges 3 have been covered, the blade 13 is retracted and the wings brush past the box walls 2 and back into the bushing 15, thus returning to the closed position, while the block 9 supports the sides of the box.

By this stage, all the portions of the sheet 4 have been applied to the respective parts of the box 1, except for the flaps 8' which are subsequently applied to the inside surfaces 6 of the walls 2 by a pad (of known type) which is inserted precisely into the box 1 according to a method that is also known and therefore not further described.

Advantageously, the flaps 7 are folded over the intermediate edges 3 during the working stroke of the blade 13 and simultaneously to the folding of the upper flap 8 or, in any case, within the same working time.

Thanks to this feature, the device according to the invention can be applied as an accessory to existing machines equipped with folding blades 13, without complicating or slowing down the box covering process.

As already mentioned, the half S2 of the box 1, in the embodiment described, is slightly larger than the half S1 and fits snugly over the latter when the box is closed. Thus, the wall 2 of the half S2 is slightly ahead of the wall 2 of the half S1.

The bushing 15 is shaped to match the form of the box and the pins 12 are positioned accordingly.

Although the present invention is especially advantageous for covering boxes with edges that are difficult to access, as in the embodiment described, it will be understood that it may be suitably adapted to cover boxes of other shapes as well.

Figure 4:
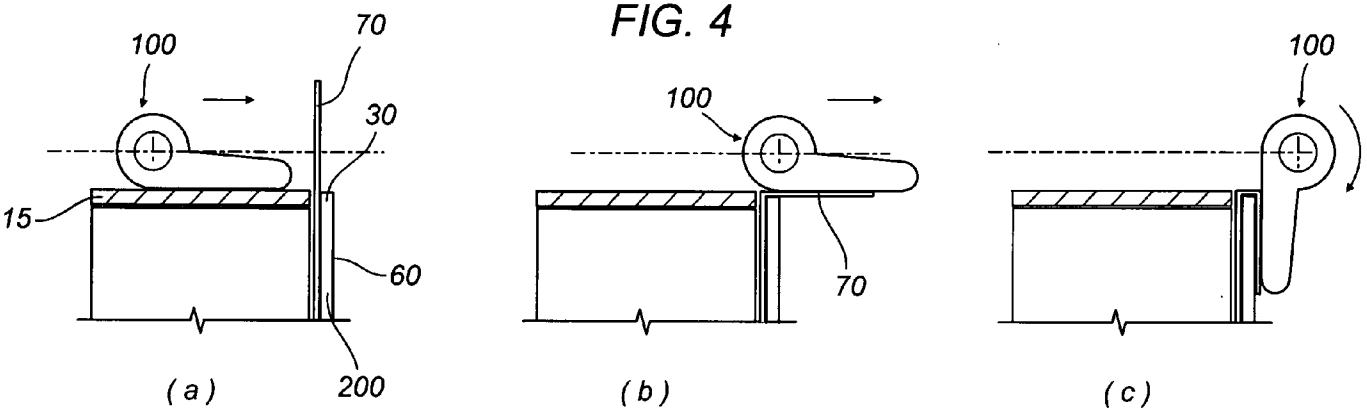
FIG. 4 schematically illustrates a device according to the invention in three different configurations (a-c) adopted during operation.
Figure 5:
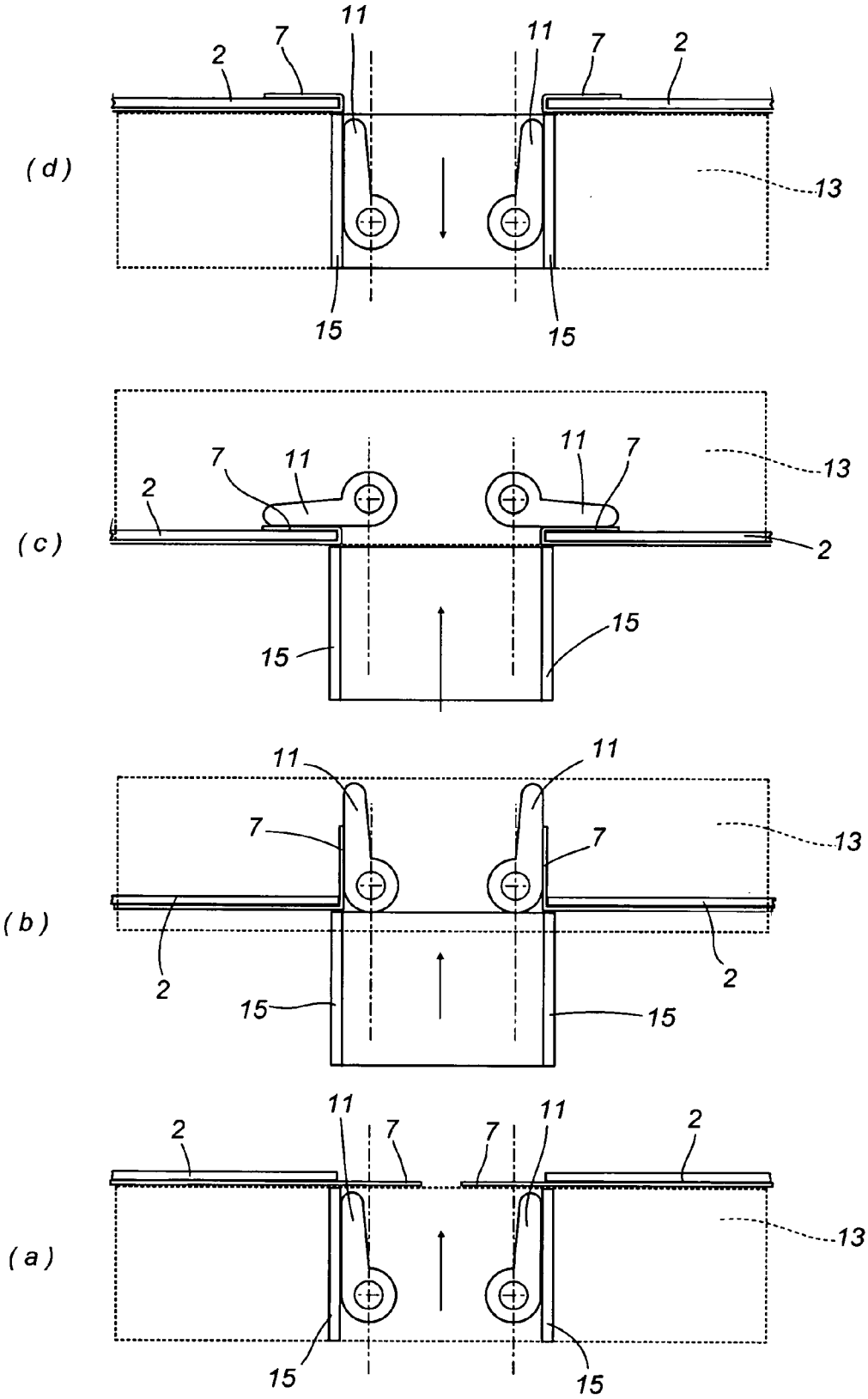
FIG. 5 shows the succession of steps in the operation of the device.

FIG. 4 schematically illustrates a device according to the invention for covering the free edge 30 of the wall 200 of a generic box to which there has been applied a glued covering sheet having a portion 70 that extends upwardly past the box wall and that is designed to cover the wall edge.

As shown, the device comprises a folding element 100, preferably in the form of a wing, that can rotate to an open position around the edge 30 in such a way as to fold the portion 70 so that it covers the edge 30 and is applied to the inside surface 60 of the wall 200.

Advantageously, the element 100 may be driven in a straight line at right angles to the wall 200 so that it moves exactly over the edge 30, thus bringing the flap 70 into contact with the edge 30 before folding the flap 70 down against the surface 60.

It will be understood that the invention described, useful in many industrial applications, may be modified and adapted in several ways without thereby departing from the scope of the inventive concept and that all the details of the invention may be substituted by technically equivalent elements.

What is claimed is:

1. A packaging box covering device for covering a free edge intermediate between an outside surface and an inside surface of a wall of a box, the device comprising one or more elements for folding a flap of a covering sheet around the intermediate edge so that the flap is made to cover the edge and then applying the flap to the inside surface of the wall; the folding elements comprising at least one wing rotatably mounted, with a return spring, on a pin attached to a support mobile at right angles to the wall, the device further comprising a guide recess in which the wing slides in a first closed configuration, the wing being driven in a straight line at right angles to the wall until said wing is outside the guide recess and rotationally, under the action of the spring about an axis parallel to the edge so as to fold the flap down against the inside surface of the wall.

2. The device according to claim 1, wherein the folding elements are driven rotationally about an axis parallel to the edge.

3. The device according to claim 1, wherein the folding elements are driven in a straight line at right angles to the wall.

4. The device according to claim 1, wherein the folding elements are driven in a straight line at right angles to the wall in contact with the edge so as to apply the flap to the edge.

5. The device according to claim 1, comprising a pair of wings that slide inside the guide recess and where the rotational movement causes the wings to open out in such a way as to cover opposite edges of a box.

6. The device according to claim 5, wherein the guide recess in which the wings slide is made in a block that moves at right angles to the wall in such a way as to press a plurality of covering flaps against the outside surfaces of the wall.

7. The device according to claim 6, wherein the guide recess is a rectangular open top bushing housed stably in the block.

8. The device according to claim 1, wherein the support consists of a blade mounted above the wings in order to fold a flap of the sheet and to cover an upper edge of the walls (2).

9. The device according to claim 8, comprising a second blade positioned below and in front of the wings and moving as one with the latter in a straight line in such a way as to fold a flap to cover a lower edge of the box.

10. The device according to claim 1, wherein the folding elements and the guide recess are made of materials with a low coefficient of reciprocal friction.

11. The device according to claim 10, wherein the folding elements are made of steel and the guide recess is made of aluminium bronze.

12. The device according to claim 1, wherein the folding elements are driven reversibly in a straight line in such a way that they slide out of the guide recess.

13. The device according to claim 1, wherein one lateral half of the recess is slightly ahead of the other with respect to the direction of straight-line motion of the block.

14. The device according to claim 1, wherein at least one pin is positioned slightly ahead of the other with respect to the direction of straight-line motion of the support.

* * * * *